US005318178A

United States Patent [19]

Davies et al.

[11] Patent Number: 5,318,178

[45] Date of Patent: Jun. 7, 1994

[54] IMPROVEMENTS IN OR RELATING TO A HOLDING DEVICE AND/OR A METHOD OF HOLDING

[75] Inventors: Robert J. Davies; Alexander G. Blair; Clifford R. Moss, all of Auckland, New Zealand

[73] Assignee: Printpac-UEB Limited, Auckland, New Zealand

[21] Appl. No.: 898,585

[22] Filed: Jun. 15, 1992

[30] Foreign Application Priority Data

Jun. 13, 1991 [NZ] New Zealand ..... 238520

[51] Int. Cl.[5] ..... B65D 71/00

[52] U.S. Cl. ..... 206/151; 206/152

[58] Field of Search ..... 206/139, 145, 147-161, 206/144, 192, 432; 294/87.2

[56] References Cited

U.S. PATENT DOCUMENTS

| | | | |
|---|---|---|---|
| 3,075,799 | 1/1963 | Weiss . | |
| 3,245,711 | 4/1966 | Dantoin . | |
| 3,317,234 | 5/1967 | Burford | 206/145 |
| 3,414,313 | 12/1968 | Schwartz . | |
| 3,540,582 | 11/1970 | Wood et al. | 206/192 |
| 3,653,503 | 4/1972 | Arneson . | |
| 3,764,001 | 10/1973 | Graser | 206/148 |
| 3,834,750 | 9/1974 | Gauntlett | 206/148 |
| 4,077,516 | 3/1978 | Duerr | 206/432 |
| 4,289,236 | 9/1981 | Ganz et al. | 206/432 |
| 4,911,290 | 3/1990 | Karabedian et al. | 206/151 |

FOREIGN PATENT DOCUMENTS

| | | | |
|---|---|---|---|
| 0697773 | 11/1964 | Canada | 206/153 |
| 1552401 | 1/1968 | France . | |
| 2072659 | 11/1970 | France . | |
| 1200696 | 3/1968 | United Kingdom . | |
| 1299590 | 11/1970 | United Kingdom . | |
| 1266740 | 3/1972 | United Kingdom . | |

OTHER PUBLICATIONS

Known Habitually Practised Technology Collection, 1983, Showa 58, p. 531.

*Primary Examiner*—Jimmy G. Foster

*Attorney, Agent, or Firm*—Jacobson, Price, Holman & Stern

[57] ABSTRACT

A holding device including a sheet member (1) shaped and configured to form a channel (5) therein, slots (*7a*, *7b*) in the sheet member to receive the rims (11) of a plurality of articles each having a rim, and a separate bridge part (20) connected to the sheet member (1) so as to span the channel (5) to maintain the channel (5) in the sheet member (1) and thereby maintain the articles in engagement with the sheet member (1) in use.

16 Claims, 11 Drawing Sheets

IMPROVEMENTS IN OR RELATING TO A HOLDING DEVICE AND/OR A METHOD OF HOLDING

BACKGROUND OF THE INVENTION

This invention relates to a holding device and has been devised particularly though not necessarily solely for use in holding beverage cans which are necked at one end.

It is often convenient to assemble a group of articles such as beverage cans into a batch or group for ready transportation or storage. One method of achieving this is to put the articles into a box or tray or provide a full wrap about the articles. Such methods are wasteful of packaging material.

Attempts to reduce the amount of required packaging material have been made. For example, U.S. Pat. Nos. 3,414,313 and 3,075,799 to Schwartz and Weiss, respectively, each show constructions which engage the top of a can. However, each construction requires a substantial width of space to fold the holder onto the cans. Also, the particular constructional method used means that the technique cannot be extended to multiple rows of cans.

U.S. Pat. No. 3,245,711 to Dantoin shows a construction which can receive multiple rows of cans but requires complex folding of the holding material to achieve its result.

U.S. Pat. No. 3,653,503 to Federal Paper Board Company describes a construction wherein the tops of cans are held by a sheet material pushed downwardly between two rows of cans and at the edges of the sheet. The package is held in this position by a cover formed by end panels which are folded over the top of the cans and parts of the holding device engaged to the cans. The construction is however disadvantageous in that substantially space is required on each side and above the assembly line to accommodate the movements required of the end panels.

Furthermore, the large area of packaging material introduces complexities into handling.

Plastics packaging is available in the form of interconnected rings of plastics material having some stretch. While such packaging has found wide acceptance it too is disadvantageous in view of the long period required for discarded packaging to degrade plus the possibility of wild life being often fatally trapped or choked by the rings of material.

BRIEF SUMMARY OF THE INVENTION

It is therefore an object of the present invention to provide a holding device and/or a method of holding articles which will obviate or minimize the foregoing disadvantages in a simple yet effective manner.

Accordingly in one aspect the invention consists in a holding device comprising a sheet member shaped and configured to form a channel therein, means to receive the rims of a plurality of articles each having a rim, and a separate bridge part able to be connected to the sheet member so as to span the channel to maintain the channel in the sheet and thereby maintain the articles in engagement with the sheet in use.

In a further aspect the invention consists in a holding device comprising a sheet member shaped and configured to form a channel therein, means to receive the rims of a plurality of articles each having a rim, and a separate bridge part spanning the channel and connected to the sheet member at each side of the channel to maintain the channel in the sheet and thereby maintain the articles in engagement with the sheet in use.

In a still further aspect the invention consists in a method of holding articles comprising the steps of providing a sheet member forming a channel in the sheet member and engaging the sheet member with the rim of a plurality of articles, each having a rim, and engaging a bridge part across the channel to maintain the channel in the sheet and thereby maintain the articles in engagement with the sheet.

This invention may also be said broadly to consist in the parts, elements and features referred to or indicated in the specification of the application, individually or collectively, and any or all combinations of any two or more of the parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the invention will now be described with reference to the accompanying drawings wherein.

DETAILED DESCRIPTION

Figure 1:
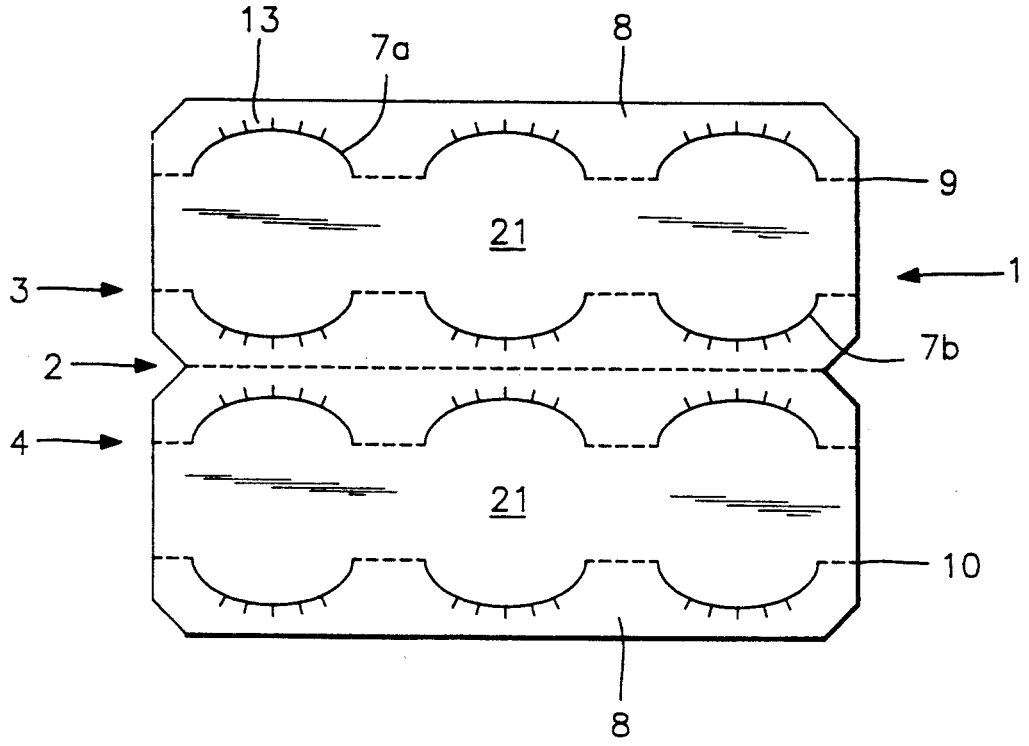
FIG. 1 is a plan view of one form of sheet member able to be used in a holding device according to the invention.

Referring to the drawings, a holding device is provided which comprises a sheet member 1 formed of a sheet material such as, for example, paper board or cardboard and the sheet member 1 is shaped and configured so that a channel can be formed therein and so that the sheet member can engage the rims of a plurality of rimmed articles, such as cans. The cans may be beverage cans in which the operable end is necked but the invention may be used with other rimmed cans or rimmed articles. This may be achieved by providing the sheet 1 with at least three substantially parallel fold lines 2, 3 and 4.

Figure 6:
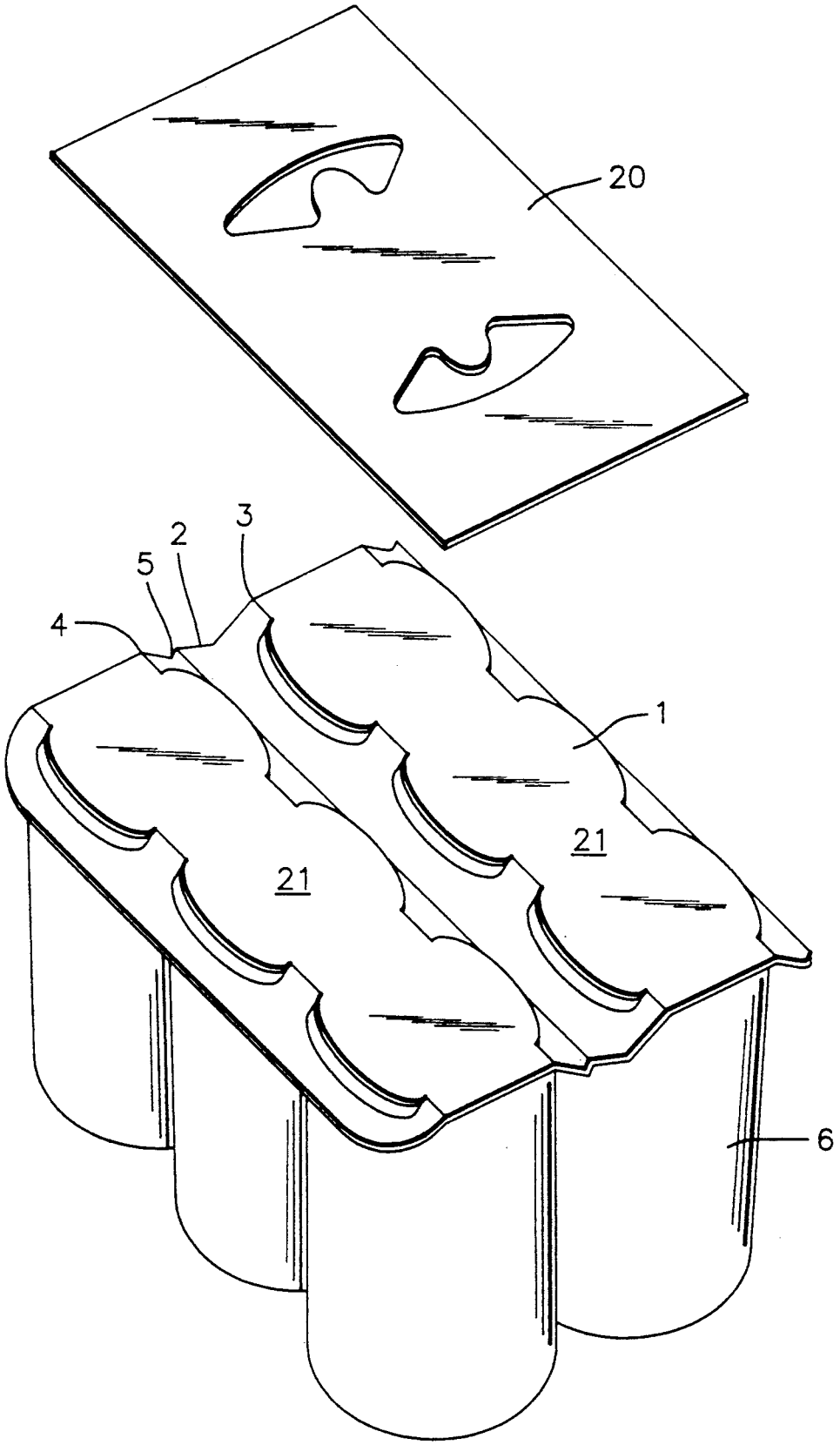
FIG. 6 is an exploded perspective view of a holding device according to the invention.
Figure 8:
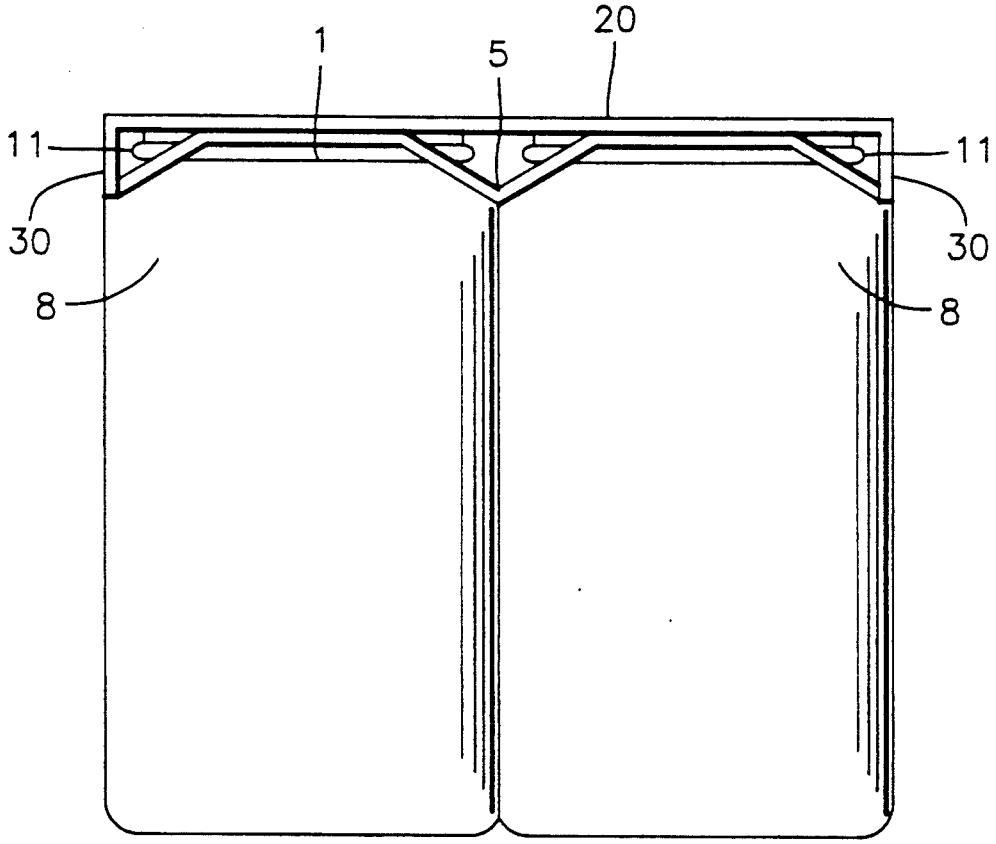
FIG. 8 is an end view of the construction of FIG. 5.

If the fold lines 3 and 4 are folded so that the fold line 2 is out of the plane of the sheet member 1 a channel 5 will be formed as can be clearly seen in FIGS. 6 and 8.

The sheet member 1 described herein is designed to be engageable with a necked article, for example, a beverage can 6 of the type which is provided with a neck at the top end terminating in a rim. The rim is able to be engaged with pairs of substantially arcuate slots such as *7a* and *7b*, that is to say slots which are substantially arcuate, though as can be seen from FIGS. 1 and 2 the preferred slot is not arcuate being somewhat flattened. The precise shape of the slots *7a* and *7b* will depend on the radius of the can top and size of the can rim. Thus, the best shape of slots *7a* and *7b* can be determined empirically for any particular article to be held.

Figure 2:
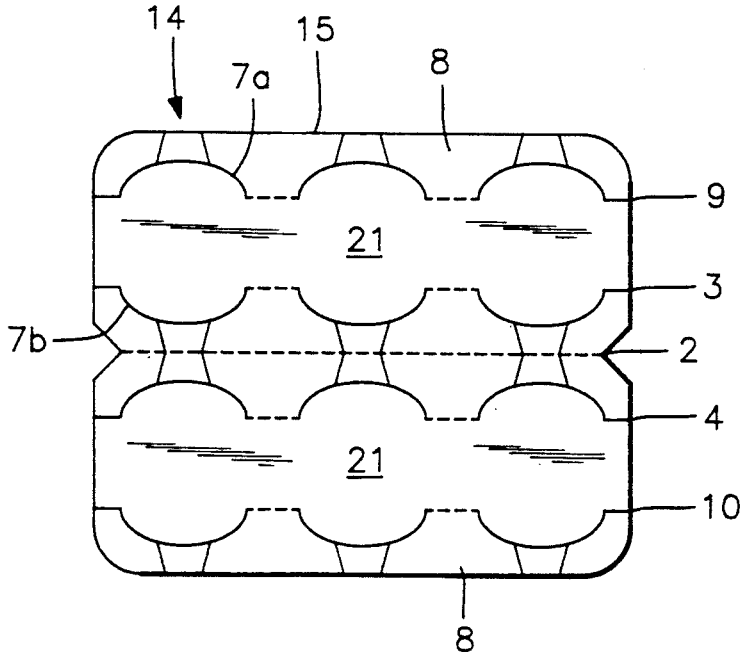
FIG. 2 is a plan view of an alternative sheet member.

The slots *7a* and *7b* are provided in pairs and in FIG. 1 and 2 two rows of three pairs of slots are provided so that the holding device including the sheet 1 will hold six beverage cans. It will be immediately apparent that other numbers of pairs of slots could be provided to hold different numbers of cans, for example, two rows of four cans to form eight cans or three rows of four cans to form twelve cans by way of example. Where twelve cans in three rows of four are to be provided then two substantially parallel channels 5 would be provided. A twelve can construction will be described further herein.

The outer side edges 8 of the sheet member 1 are also separated from the remainder of the material by fold lines 9 and 10 so that the outer parts 8 can be folded to at least some extend downwardly to engage the can rims 11. Fold lines 9 and 10 are substantially parallel to fold lines 2, 3 and 4.

The sheet material 1 is desirably modified about slots *7a* and *7b* so as to increase the engagement between the sheet material 1 and the can rims 11. In FIG. 1 this is achieved by providing sunburst type slots or slits 13 and in FIG. 2 this is achieved for example by providing outwardly converging crease lines as at 14.

Where the article to be held is a typical soft drink or beer can the crease lines 14 in a pair may be about 1.2 cm apart at the edge 15 of the sheet 1 and about 1.7 cm apart at the slot *7a* where the shortest distance from the edge 15 to slot *7a* is about 1 cm. Again, radius and rim size may affect these dimensions and the best angles and length can be empirically determined for any selected can. The crease lines 14 are shown extending substantially from edge 15 to slot *7a* but can and rim size again may require that the crease lines 14 are shorter than this.

Figure 7:
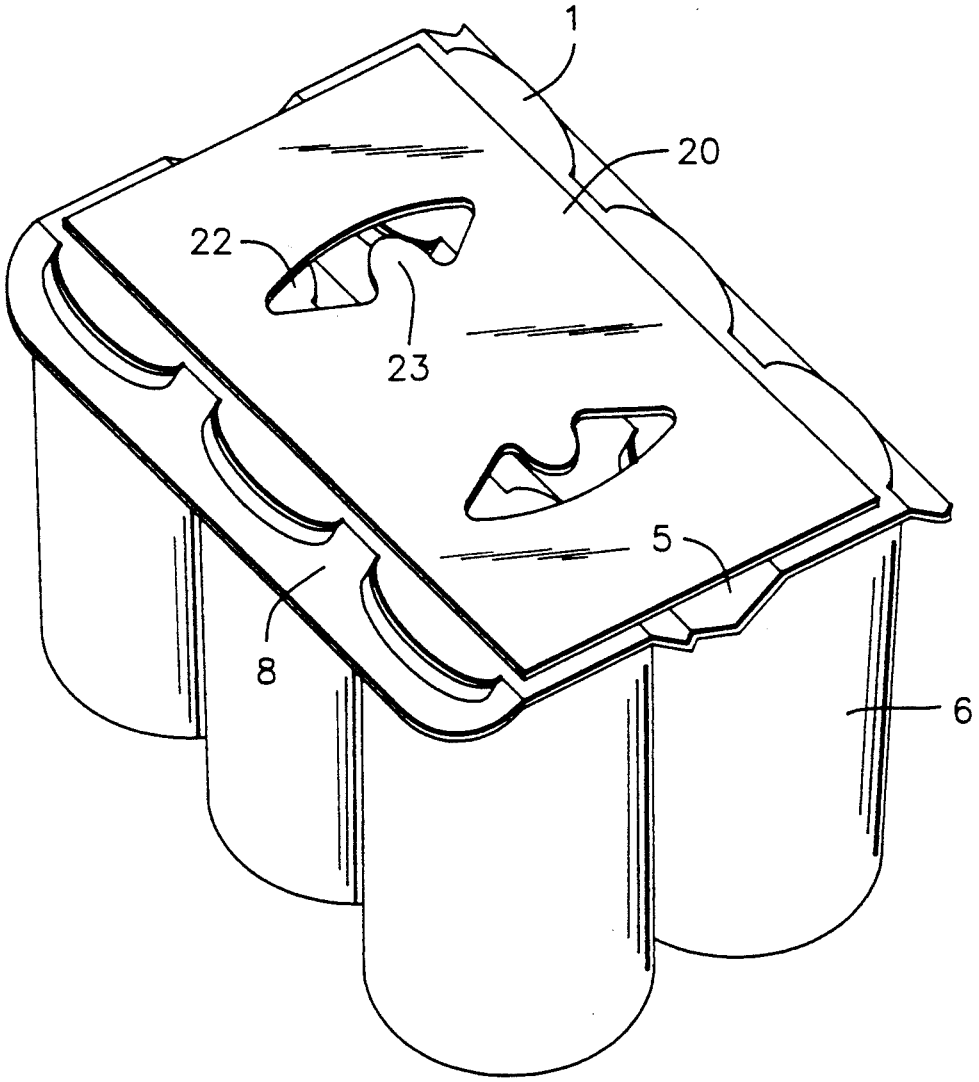
FIG. 7 is a perspective view of the holding device of FIG. 6 in assembled form.

A bridge piece 20 is provided to span the channel 5 as can be seen, for example, in FIG. 7. Thus, in use the cans 6 are held in the desired arrangement and the sheet member 1 placed thereover so that the rims 11 catch in the arcuate slots *7a* and *7b*. This can be arranged to be done mechanically by providing suitable pressure members in the desired positions. As the channel 5 is formed the two rows of cans 6 are moved relatively inwardly.

The bridge piece 20 is then placed across the channel 5 being, for example, glued or adhered into position. The bridge piece 20 is glued or adhered to the arms 21 at each side of the channel 5.

Figure 3:
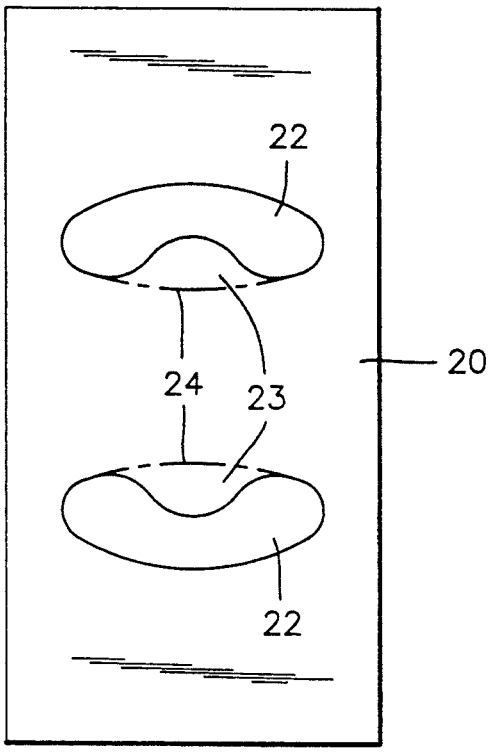
FIG. 3 is a plan view of one form of bridge member able to be used in conjunction with the sheet member of FIG. 1 or FIG. 2 to form a holding device according to one preferred form of the invention.

The bridge member 20 preferably includes a handle and for example in FIG. 3 a pair of cut outs 22 may be provided with a tongue 23 extending into the cut out 22. The dimensions of the tongue 23 are such that the tongue 23 may be pressed into the channel 5 in the erected holding device, preferably being a close fit. A crease or fold line 24 may be provided to facilitate movement of tongue 23 into the channel 5 in use.

Figure 5:
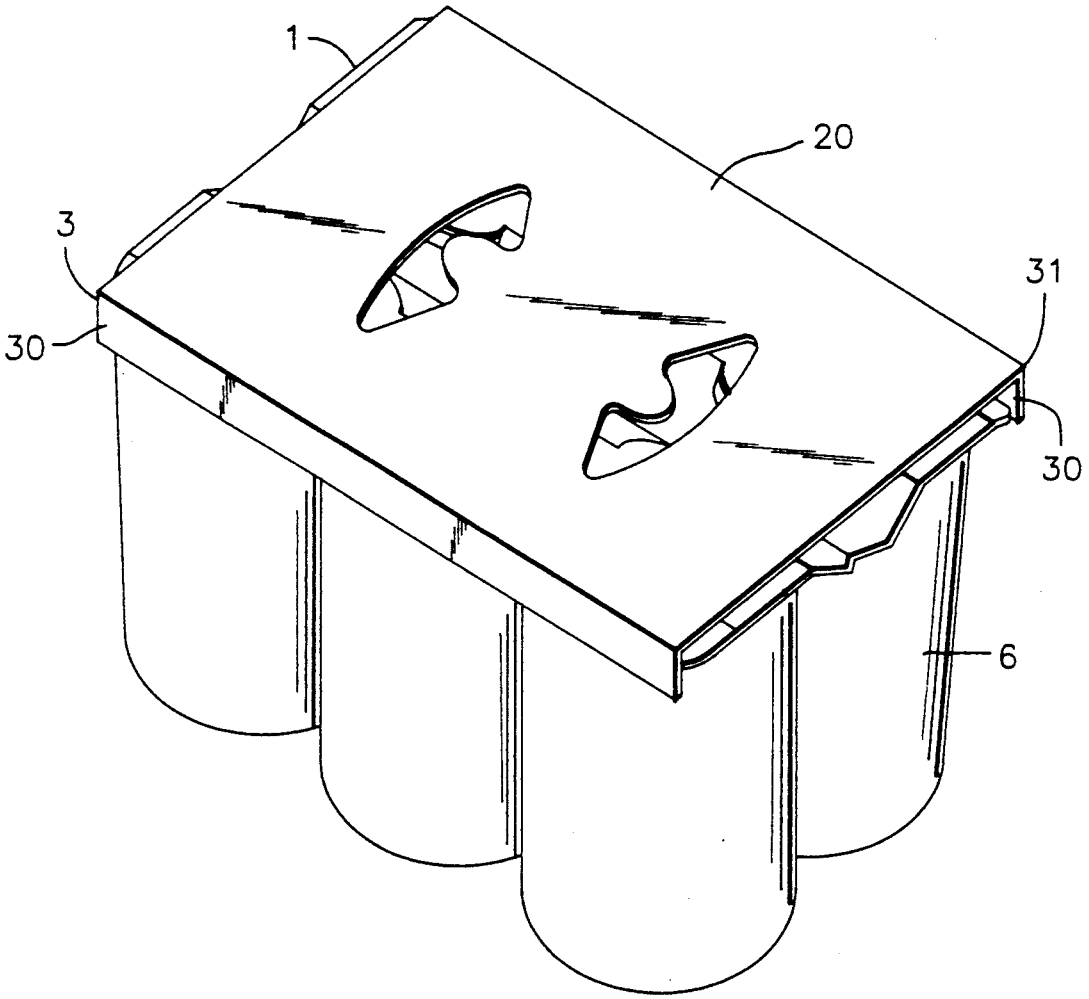
FIG. 5 is a perspective view of a holding device according to the invention, in use and showing an alternative bridge member.

In the embodiment of FIGS. 5 and 8 the bridge piece 20 has down turned side edges 30 separated from the body of bridge piece 20 by fold lines 31. The down turned side edges 30 give some protection to the exposed can rims 11 and can be adhered to the edge of down turned parts 8 of the sheet 1 if desired or necessary.

Figure 9:
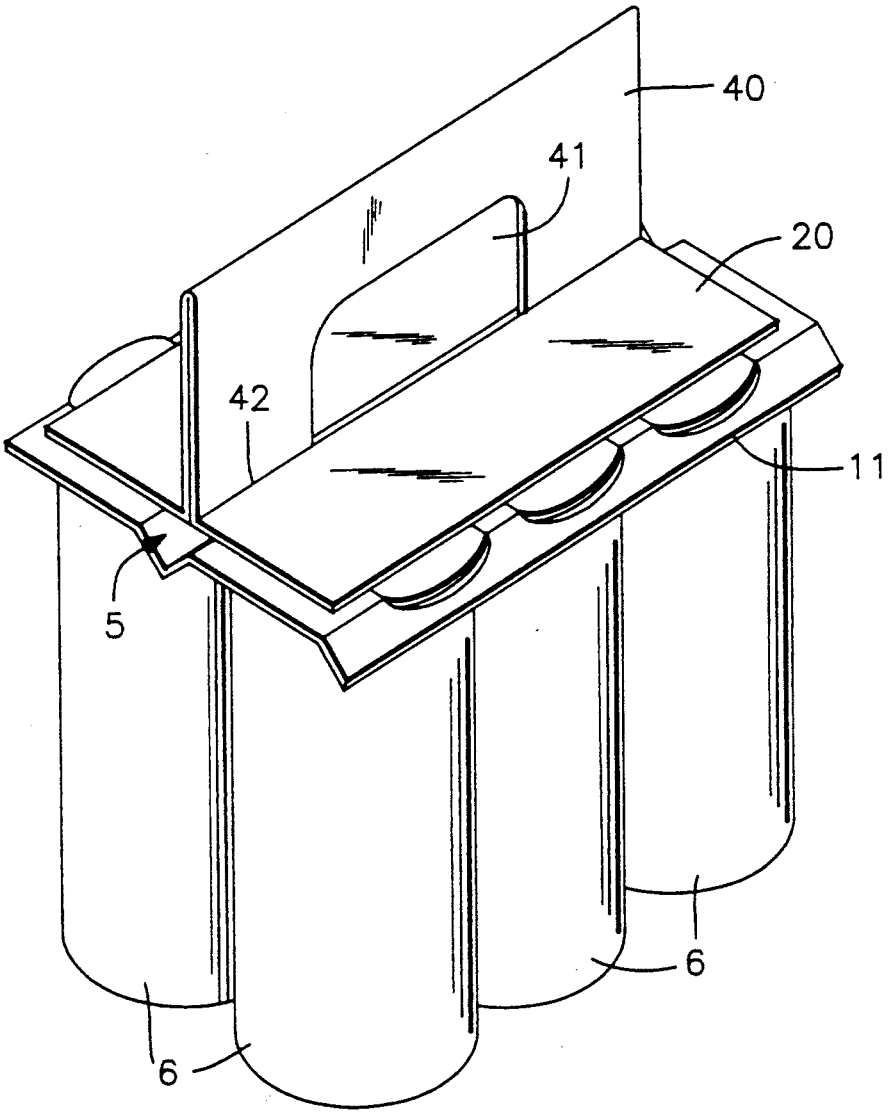
FIG. 9 is a perspective view of a holding device according to the invention in a further alternative form.

In FIG. 9 the bridge piece 20 has an upwardly extending portion 40 with cut out 41 therein so as to provide a more conventional handle. The double thickness upwardly extending portion 40 may have the two sheets adhered one to the other and crease lines 42 may be formed between the portion 40 and the remainder of the handle.

Figure 4:
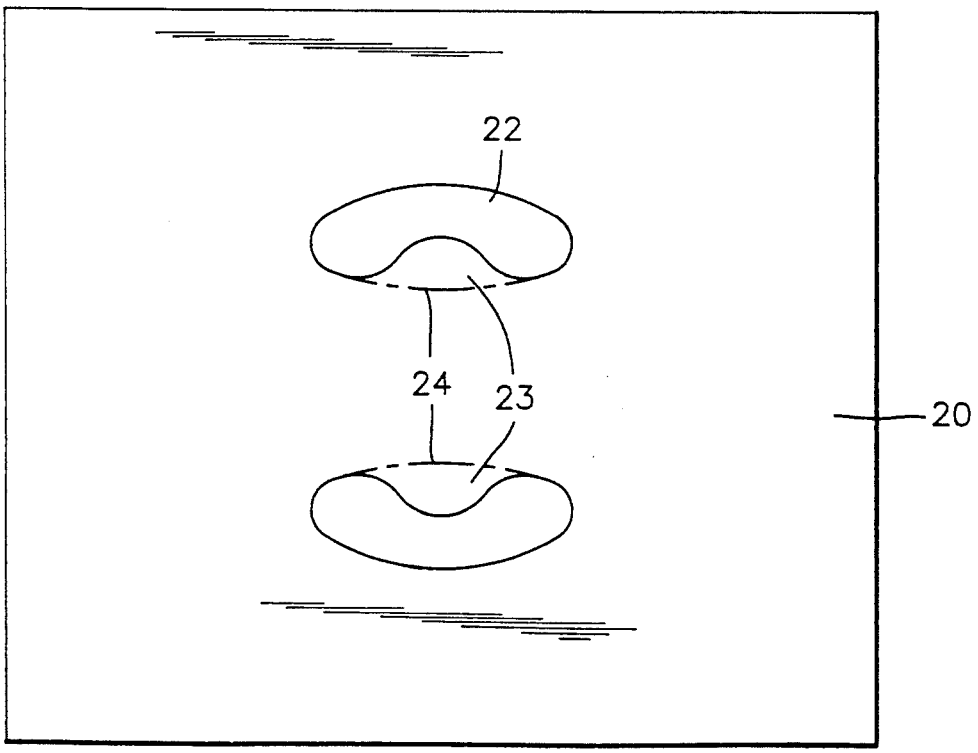
FIG. 4 is a plan view of an alternative bridge member for use with larger numbers of articles to be held.
Figure 10:
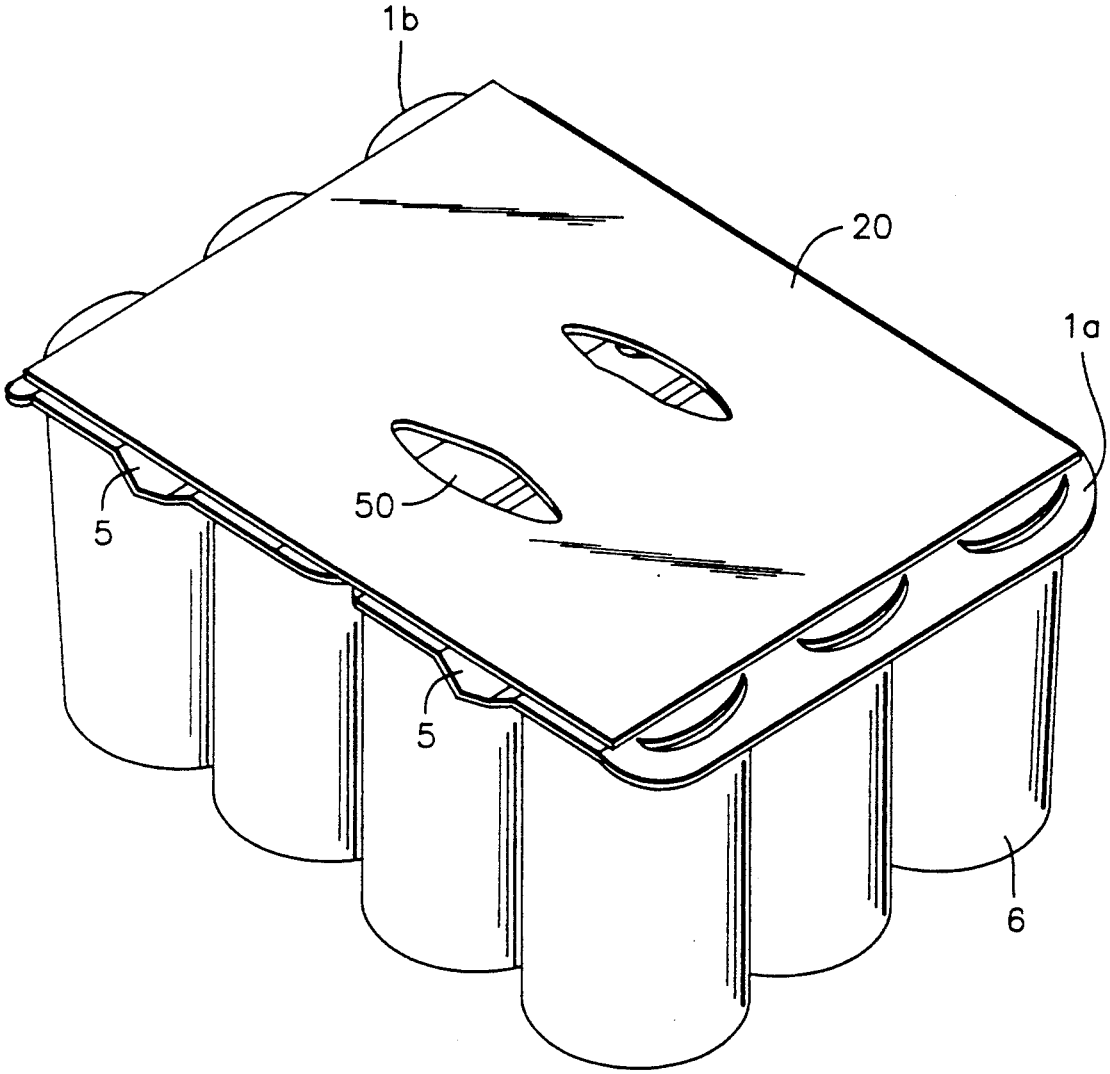
FIG. 10 is a perspective view of a holding device according to the invention in a still further alternative form in which a larger number of articles are held by the holding device.

In the embodiment of FIG. 10 twelve cans 6 are held by a pair of sheet members 1A or 1B. They are spanned by the bridge piece 20 shown in FIG. 4. The tongues 23 are pushed in use into a third channel 50 formed by adjacent side edges 8 of the two sheet members 1A or 1B. The bridge piece 20 is adhered to each of the four areas 21 in the preferred construction.

Figure 11:
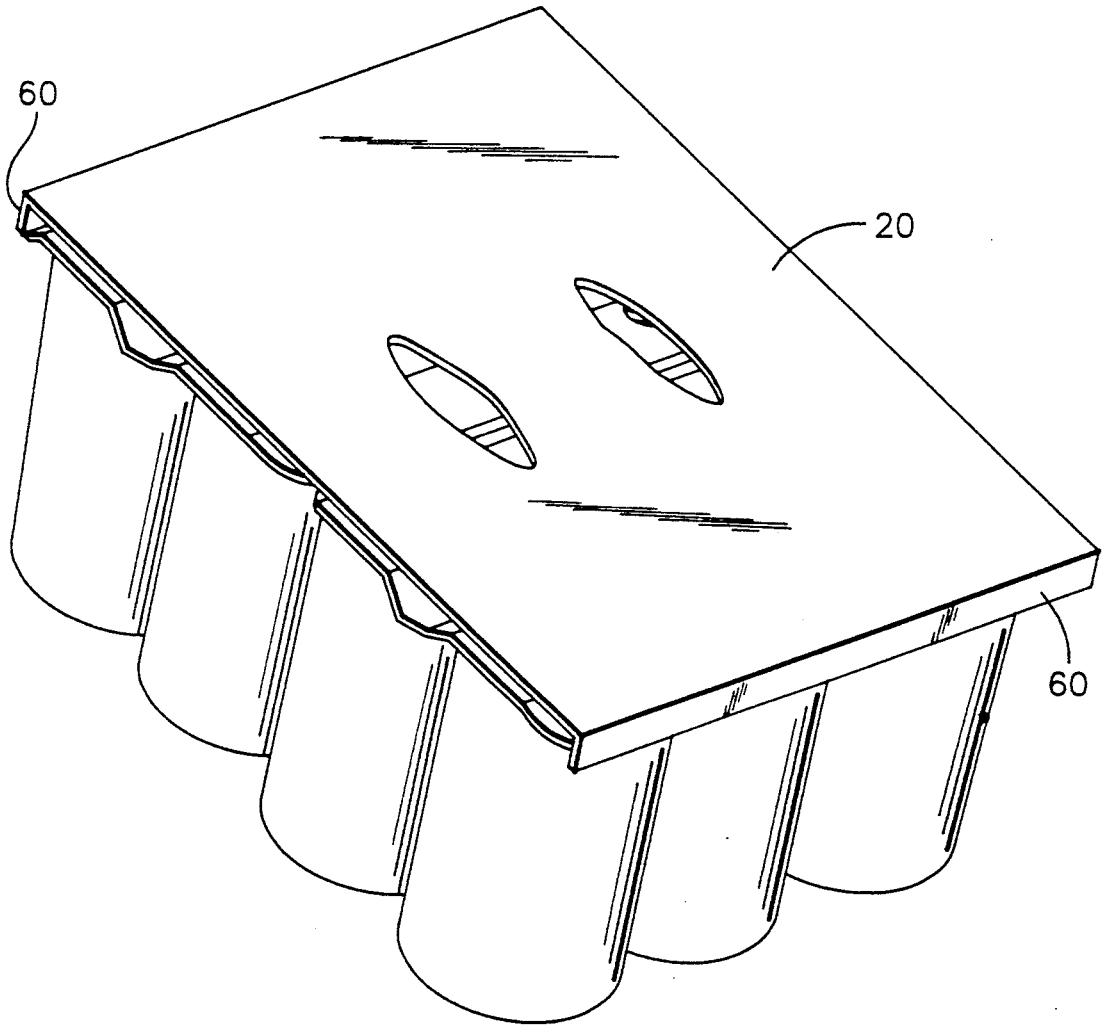
FIG. 11 is a perspective view of an alternative form of the invention shown in FIG. 10.

The construction of FIG. 11 is as for FIG. 10 save that the bridge part 20 has side edges 60 similar to those described for FIG. 5.

Figure 12:
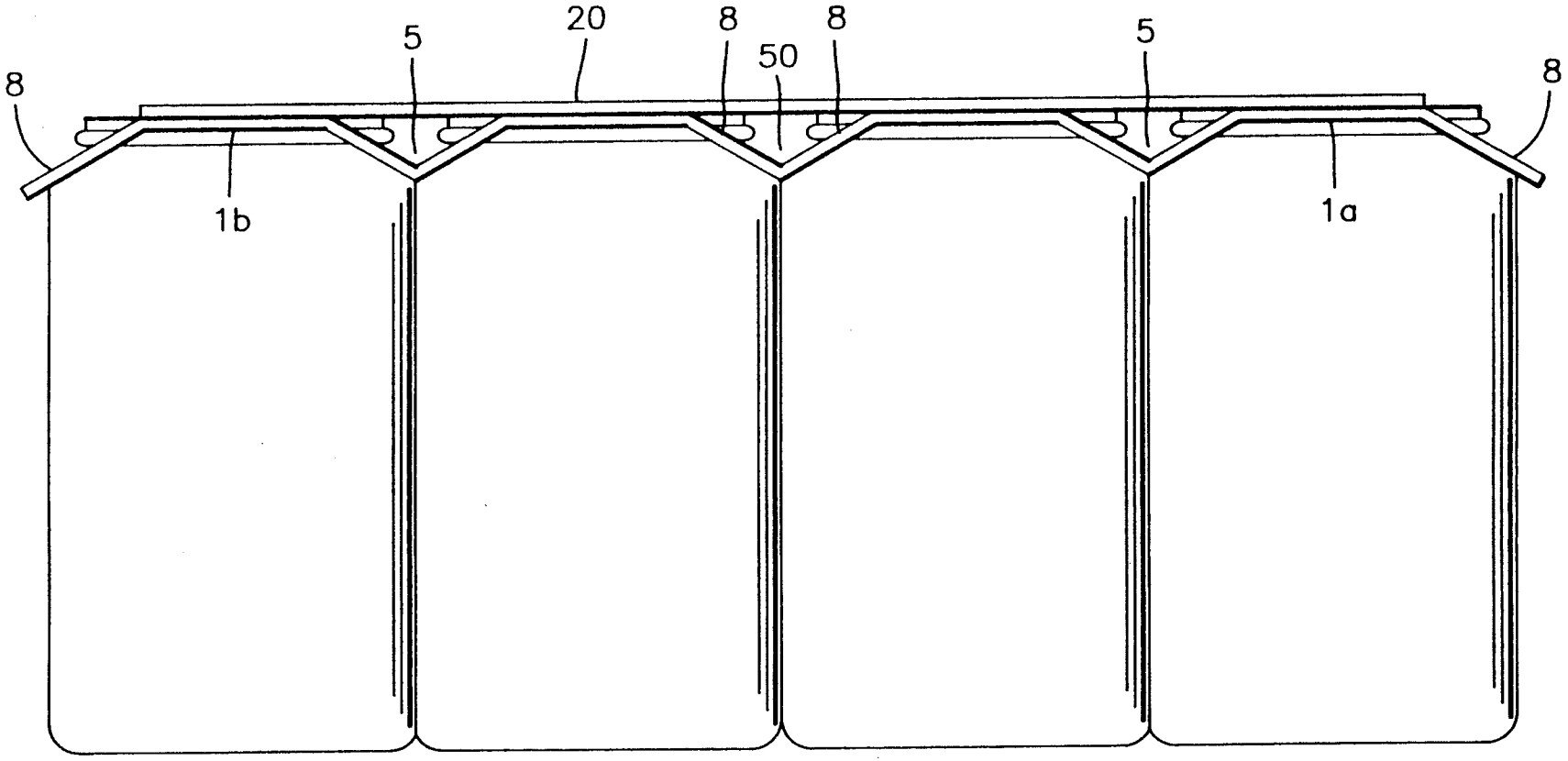
FIG. 12 is an end view of the construction of FIG. 10.
Figure 13:
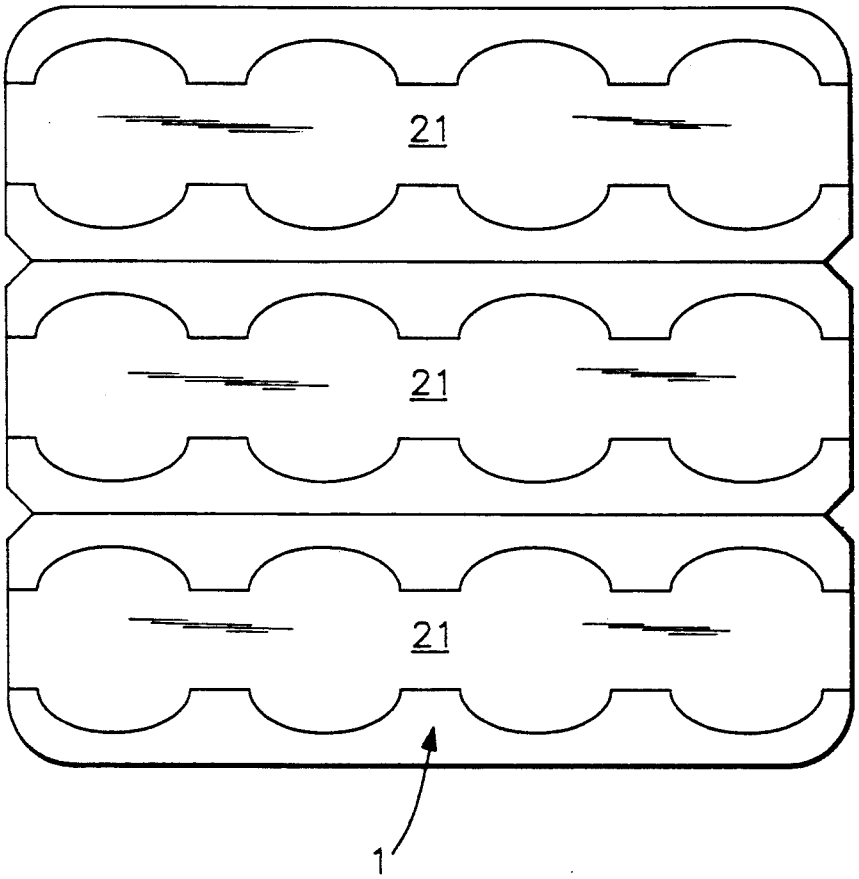
FIG. 13 is a plan view of a sheet forming part of an alternative construction to that shown in FIGS. 10 to 12.

FIG. 13 shows an alternative sheet 1 for holding twelve cans. The sheet 1 has fold lines 2, 3 and 4 represented so that in the erected construction two channels 5 are formed. These may be mounted by adhering a bridge part 20 as shown, for example, in FIG. 4 to the construction. The bridge part 20 is adhered preferably to the edge of the three areas 21 and is therefore oriented in a direction at right angles to the direction of orientation of the bridge part 20 shown in FIGS. 10 to 12.

In use the holding device is applied to necked beverage cans in particular in the manner described. The cans may then be carried as desired and simply removed by a levering or twisting type action between the beverage can or other article and the holding device. The material from which the sheet material is made must be of sufficient stiffness to retain the cans in position but of sufficient flexibility so that the cans can be removed therefrom when desired.

Thus it can be seen that at least in the preferred form of the invention a holding device is provided and/or a method of holding articles is provided which has the advantage that the holding device can be made of cardboard or paperboard which has environmental advantages and which uses substantially less material than full wrap around or other single piece constructions. That is to say the volume of packaging material used is minimized. One large area of board is more difficult to handle than the two smaller areas of the invention. This is particularly so when the packaging is operating at commercial speeds.

The two piece construction of the invention has other advantages. For example, the manufacturer can cross grain the two pieces of board which has its maximum tear strength across the grain. Thus, the sheet member can have its grain running one way and the bridge have its grain running the other. Thus, lighter weight board can be used than in a one piece construction while retaining adequate strength. Also, the two piece construction gives flexibility in printing as combinations can be made. A user could, by way of example, print the sheet member on a "house" basis and the bridge on a "brand" basis allowing the thus more generic sheet member to be associated with a selected bridge of those available.

The construction is such that the loading operation of articles into holding devices can be effected in a way that is economical of machine space, particularly where multiple lines are operating and also economical in board usage. The construction is also advantageous in allowing the use of paper board or cardboard which being more biodegradable than plastics is less likely to cause environmental damage than packaging formed from many of the available plastics materials.

What we claim is:

1. A holding device for a plurality of articles each having a rim comprising:

a sheet member shaped and configured to form at least two article engaging areas and a channel between said article engaging areas;

rim receiving means in each of said article engaging areas for receiving rims of a plurality of articles;

at least three substantially parallel adjacent fold lines in said sheet member forming said channel, said sheet member being folded along said fold lines so that the central fold line of three adjacent fold lines is displaced from said article engaging areas to form said channel, the two outer fold lines of said three adjacent fold lines comprising segments extending from said rim receiving means so that said channel is disposed between said rim receiving means in each of said article engaging areas; and a separate bridge part spanning said channel and at least part of each of said at least two article engaging areas and bonded to said at least two article engaging areas on each side of said channel so that said article engaging areas are in fixed spaced relationship to maintain said channel in said sheet member and thereby maintain said rim receiving means in engagement with said articles in use.

2. A holding device as claimed in claim 1 wherein:

said sheet member has two opposite side edges; and said rim receiving means comprise a plurality of pairs of slots in said sheet member, one slot in each pair being provided adjacent said channel and the other slot in each pair being positioned adjacent one of said side edges of said sheet member outwardly of said channel.

3. A holding device as claimed in claim 2 wherein:

said sheet member has a shaped formation adjacent said slots to assist retention of said slots in engagement with said articles.

4. A holding device as claimed in claim 3, wherein:

said shaped formation comprises a pair of crease lines positioned between each of said other slots and the adjacent edge of said sheet member.

5. A holding device as claimed in claim 4 wherein:

the distance between said crease lines of each pair of crease lines is reduced in the direction away from said other slot.

6. A holding device as claimed in claim 2 and further comprising:

a pair of crease lines positioned between each of said other slots and the adjacent side edge of said sheet member.

7. A holding device as claimed in claim 6 wherein:

the distance between said crease lines of each pair of crease lines is reduced in a direction away from said other slot.

8. A holding device as claimed in claim 6 wherein:

a pair of sheet members are provided and said bridge part has a size so that said bridge part spans said pair of sheet members; and said bridge part is bonded to said pair of sheet members.

9. A holding device as claimed in claim 2 and further comprising:

a plurality of slits in said sheet member extending from said one slot of each pair of slots toward said channel and from said other slot of each pair of slots toward the adjacent side edge to assist retention of said sheet member in engagement with said articles.

10. A holding device as claimed in claim 9 wherein:

a pair of sheet members are provided; and said bridge part spans and is bonded to said pair of sheet members.

11. A holding device as claimed in claim 1 wherein:

a pair of sheet members are provided; and said bridge part spans and is bonded to said pair of sheet members.

12. A holding device as claimed in claim 1 wherein:

a pair of sheet members are provided; and said bridge part has a size so that said bridge part spans and is bonded to said pair of sheet members.

13. A method of holding a plurality of articles each having a rim comprising:

providing a sheet member having two opposite side edges;

providing at least three substantially parallel fold lines in said sheet member;

folding said sheet member at said fold lines to form a channel in said sheet member between said side edges and between two rows of said articles so that the two outer fold lines of said three fold lines comprise segments extending from rim receiving means on said sheet member on opposite sides of said channel;

engaging said rim receiving means on said sheet member with rims of a plurality of said articles;

providing a separate bridge part;

positioning said bridge part across said channel and over at least part of said sheet member on opposite sides of said channel; and connecting said bridge part to said sheet member on each side of said channel to maintain said formed channel in said sheet member and thereby maintain said sheet member in engagement with said articles.

14. A method of holding articles as claimed in claim 13 and further comprising:

providing a plurality of pairs of slots in said sheet member with one slot in each pair being adjacent said channel and the other slot in each pair being adjacent a side edge of said sheet member to form said rim receiving means; and engaging said sheet member with said rims of said articles by forcing each of said rims into a respective pair of said slots by applying pressure between said sheet member and said articles.

15. A holding device for a plurality of articles each having a rim comprising:

a sheet member having two opposite side edges and shaped and configured to form at least two article engaging areas and a channel between said article engaging areas;

at least three substantially parallel fold lines in said sheet member to form said channel in said sheet member when folded along said fold lines;

rim receiving means in each of said article engaging areas for receiving rims of a plurality of said articles, said rim receiving means comprising a plurality of pairs of slots in said sheet member, one slot in each pair being provided adjacent said channel and the other slot in each pair being positioned adjacent one of said side edges of said sheet member outwardly of said channel;

a pair of crease lines in said sheet member extending from each of said other slots to the adjacent side edge of said sheet member to assist retention of said slots in engagement with said articles; and a separate bridge part spanning said channel and connected to said article engaging areas on each side of said channel to maintain said channel in said sheet member and thereby maintain said rim receiving means in engagement with said articles in use.

16. A holding device for a plurality of articles each having a rim comprising:

a sheet member shaped and configured to form a channel therein;

rim receiving means on said sheet member for receiving rims of said plurality of articles comprising a plurality of pairs of slots in said sheet member, one slot in each pair being adjacent said channel and the other slot in said each pair being adjacent a side edge of said sheet outwardly of said channel, each slot being shaped to engage a respective rim along substantially the length of said rim;

a pair of crease lines extending from each of said other slots to the adjacent side edge of said sheet member; and a separate bridge part spanning said channel and connected to said sheet member to maintain said channel in said sheet member and thereby maintain said pairs of slots in engagement with said rims of said articles in use.

* * * * *